US009236694B2

(12) United States Patent
Binder et al.

(10) Patent No.: US 9,236,694 B2
(45) Date of Patent: Jan. 12, 2016

(54) COAXIAL, PLUG AND SOCKET CONNECTORS WITH PRECISION CENTERING MEANS

(71) Applicant: SPINNER GmbH, München (DE)

(72) Inventors: Thomas Binder, Bruckmühl (DE); Zlatko Dovranic, München (DE)

(73) Assignee: SPINNER GMBH, Munich (DE)

( * ) Notice: Subject to any disclaimer, the term of this patent is extended or adjusted under 35 U.S.C. 154(b) by 0 days.

(21) Appl. No.: 14/319,965

(22) Filed: Jun. 30, 2014

(65) Prior Publication Data

US 2014/0322970 A1 Oct. 30, 2014

Related U.S. Application Data

(63) Continuation of application No. PCT/EP2013/050165, filed on Jan. 7, 2013.

(30) Foreign Application Priority Data

Jan. 11, 2012 (EP) ..... 12150763

(51) Int. Cl.
*H01R 9/05* (2006.01)
*H01R 24/40* (2011.01)
(Continued)

(52) U.S. Cl.
CPC ..... *H01R 24/40* (2013.01); *H01R 13/629* (2013.01); *H01R 13/6315* (2013.01); *H01R 24/44* (2013.01); *H01R 2103/00* (2013.01)

(58) Field of Classification Search
CPC .. H01R 24/40; H01R 13/6315; H01R 13/629; H01R 13/631; H01R 2103/00; H01R 24/44
USPC ..... 439/578–580
See application file for complete search history.

(56) References Cited

U.S. PATENT DOCUMENTS 4,929,188 A 5/1990 Lionetto et al. ..... 439/349
5,074,809 A 12/1991 Rousseau ..... 439/675
(Continued)

FOREIGN PATENT DOCUMENTS

DE 1 813 161 U 6/1960
EP 0 080 845 6/1983
(Continued)

OTHER PUBLICATIONS

Communication pursuant to Article 94(3) EPC in European Application No. 12 150 763.6 dated Sep. 2, 2013.
(Continued)

*Primary Examiner* — Javaid Nasri
(74) *Attorney, Agent, or Firm* — Norton Rose Fulbright US LLP

(57) ABSTRACT

A coaxial connector system comprises a coaxial plug connector and socket connector. The coaxial connectors have a center conductor defining a center axis of the connector and an outer conductor coaxial to the center conductor. The plug connector's outer conductor has a cylindrical shape with slits forming a plurality of spring loaded contact elements, while the socket connector's outer conductor is a cylindrical shape forming a contact surface. Furthermore, the connectors have a mechanical contact surface at a right angle to their center axis and distant from the spring loaded contact elements and the contact surface. Cylindrically precision centering means are provided at the connectors, which fit into each other and precisely align the center axis of the connectors resulting in reduced passive intermodulation. This design allows for further reducing contact gaps between the outer and inner conductors to further improve return loss at high frequencies.

10 Claims, 5 Drawing Sheets

(51) Int. Cl.

| | |
|---|---|
| ***H01R 13/629*** | (2006.01) |
| ***H01R 24/44*** | (2011.01) |
| ***H01R 13/631*** | (2006.01) |
| *H01R 103/00* | (2006.01) |

(56) References Cited

U.S. PATENT DOCUMENTS

| | | | | |
|---|---|---|---|---|
| 6,267,621 | B1 * | 7/2001 | Pitschi et al. | 439/584 |
| 7,294,023 | B2 | 11/2007 | Schneider | 439/675 |
| 2008/0254668 | A1 | 10/2008 | Rosenberger | 439/335 |
| 2011/0130048 | A1 | 6/2011 | Haunberger et al. | 439/660 |

FOREIGN PATENT DOCUMENTS

| | | |
|---|---|---|
| WO | WO 98/16971 | 4/1998 |
| WO | WO 2007/146157 | 12/2007 |
| WO | WO 2010/113536 | 10/2010 |

OTHER PUBLICATIONS

Communication pursuant to Article 94(3) EPC in European Application No. 12 150 763.6 dated Sep. 30, 2014.

European Search Report in European Application No. 12150763.6 dated Jun. 18, 2012.

International Preliminary Report on Patentability in International Application No. PCT/EP2013/050165 dated Jul. 15, 2014.

International Search Report in International Application No. PCT/EP2013/050165 dated Mar. 5, 2013.

* cited by examiner

COAXIAL, PLUG AND SOCKET CONNECTORS WITH PRECISION CENTERING MEANS

PRIORITY CLAIM

This application is a continuation of pending International Application No. PCT/EP2013/050165 filed on 7 Jan. 2013, which designates the United States and claims priority from European Application No. 12150763.6 filed on Jan. 11, 2012, both of which are incorporated by reference in their entireties.

BACKGROUND OF THE INVENTION

1. Field of the Invention

The invention relates to a coaxial plug-and-socket connector for radio frequencies (RF), comprising a socket part and a plug part and further comprising a precision centering means of the socket part and the plug part.

2. Description of Relevant Art

RF connectors as disclosed in the U.S. Pat. No. 4,929,188, having a frontal contact of the outer conductors, require a significant minimum pressure between the plug part and the socket part to obtain a low intermodulation connection. This necessitates a comparatively massive connector housing and high locking forces.

The US Patent Application Publication 2011/0130048 A1 discloses a RF connector without a frontal contact of the outer conductors. Instead, an axial mechanical stop outside the outer conductor signal path is provided. This allows for lower locking forces. The drawback is that the outer conductor current path varies with mechanical tolerances and the relative position between the plug part and the socket part. Accordingly, the return loss of the connector is degraded at higher frequencies.

This is further improved by U.S. Pat. No. 7,294,023 B2. A circular contact element is inserted into the socket housing providing a plurality of contact points. This allows for a high-quality broadband connection. The disadvantages of this design are its complexity and the associated costs.

The German utility model DE 1813161 U discloses a radio frequency plug connector, where the outer conductor contacts at its front end the socket connector. This allows for compensation of mechanical deviations. The contact springs make an outer conductor contact, even if the plug connector is located off axis relative to the socket connector. This is no precision centering.

The US patent application publication US 2008/0254668 A1 discloses a further connector, where the axial distance between plug and socket connector is defined by the outer conductor of the plug connector, contacting a surface at a reference plane within the socket connector. Furthermore, centering is not provided, as the plug connector has spring elements at the outer conductor to compensate for centering deviations.

The European patent application publication EP 0 080 845 discloses a further coaxial connector, where the axial relationship between the plug connector and the socket connector can vary due to the elasticity of a spring inserted there between.

In the international patent publication WO 2010/113536 A1, a coaxial connector for printed circuit boards is disclosed. This connector does not have an axial stop. Instead, they are notches at the outer conductor of the plug connector, which fit into grooves of the socket connector. This does not result in a well-defined axial positioning. Instead, the connector is designed in such a way to tolerate displacement in an axial direction. Furthermore, there is no centering means. Instead, the outer conductor is flexible and may compensate for variations.

SUMMARY OF THE INVENTION

The problem to be solved by the invention is to provide a RF coaxial plug-and-socket connector for low intermodulation broadband connection with high return loss which has a comparatively simple and robust mechanical design and can easily be manufactured at low cost in high volumes.

Solutions of the problem are described in the independent claims. The dependent claims relate to further improvements of the invention.

A coaxial plug connector and a coaxial socket connector each have a housing, a center conductor and an outer conductor. The center conductors define by their centers a center axis of the connectors. The outer conductors are arranged coaxially around the center conductors and held by insulators. The housing may be a part of the outer conductor.

The coaxial plug connector has an outer conductor, which fits, into a socket of the socket connector. A center conductor at the plug connector contacts and preferably fits into a center conductor of the socket connector. For mating the plug connector, the center conductor is inserted into the socket connector center conductor. Furthermore, there is preferably at least one means for mechanically fastening the plug connector to the socket connector.

The coaxial plug connector has an outer conductor with a plurality of parallel slits extending from the socket connector facing side and dividing the outer conductor into a plurality of spring loaded contact elements. These spring-loaded contact elements fit into the inner contour of the coaxial socket connector, which include cylindrical and conical sections.

To allow for a high-quality electrical contact, means for positioning of the plug connector in relationship to the socket connector are provided. The plug connector has a mechanical contact surface at a right angle to its center axis. The socket connector has a corresponding mechanical contact surface, which also is at a right angle to the connector's center axis. The mechanical contact surfaces define a mechanical reference plane for each connector. When mated, both mechanical contact surfaces are in close contact with each other. Therefore, the mechanical contact surfaces define the spatial relationship of the plug connector and the socket connector in the direction of the center axis, when the connectors are mated. This may allow for a precise positioning of the plug connector relative to the socket connector. Here, the mechanical contact surfaces are not part of the outer conductors' electrical contacts, as known from prior art. Instead, the mechanical contact surfaces are separate surfaces, distant from the spring loaded contact elements.

The coaxial connectors furthermore have precision centering means for aligning the center axis of the plug connector with the center axis of the socket connector. The plug connector preferably has a cylindrical outer surface of the inner conductor, while the socket connector preferably has a cylindrical inner surface of the outer conductor. The precision centering means are distant from the spring loaded contact elements. Furthermore, it is preferred, if the precision centering means are distant from the mechanical contact surfaces defining the spatial relationship of the plug connector and the socket connector in the direction of the center axis. The cylindrical inner surface fits tightly into the cylindrical outer surface and therefore limits parallel displacement of both center axes, so that the center axis of the plug connector is aligned with the center axis of the socket connector. Alternatively, the precision centering means may have a conical shape including a conical surface at the plug connector and at the socket connector. Furthermore, it is preferred, if the precision centering means and/or the mechanical contact surfaces are sized to prevent tilting of the plug connector against the socket connector.

Due to the precision positioning means the location of the plug connector with respect to the socket connector is laterally (radially) and axially within a comparatively low tolerance. When mated, these spring-loaded contact elements of the plug connector's outer conductor are in electrical contact with the outer conductor of the socket connector at a socket connector contact surface. Due to the high precision centering, the contact forces of all spring-loaded contact elements are equal. This results in an even current distribution and therefore high return loss and low passive intermodulation. Allowing for a simple and low pressure mating of the connectors, a conical section is provided at the socket connector's outer conductor, which continuously forces the spring-loaded contact elements to a smaller radius when mating the connector. Dependent on the slope of the conical section low insertion forces and high contact pressures may be obtained.

The socket connector has a circular protrusion at the inner side of its outer connector. The inner radius of the protrusion is preferably the same as the inner radius of the plug connector's outer conductor spring loaded contact elements, when mated. This results in an approximately constant inner radius throughout the mated connector. The end of plug connector's outer conductor is in close proximity to the protrusion, but still distant from the protrusion to allow for capacitive coupling which improves high frequency performance. This can only be achieved by the defined spatial relationship of the plug connector and the socket connector, as it is done by the mechanical contact surfaces and the precision centering means.

In a preferred embodiment, an O-ring is provided preferably at the plug connector for sealing the gap between the plug connector outer conductor and the socket connector outer conductor when mated. This O-ring is preferably located at an inner side of the connector related to a mechanic it contact surface and close to a mechanical contact surface.

BRIEF DESCRIPTION OF THE DRAWINGS

In the following, the invention will be described by way of example, without limitation of the general inventive concept, on examples of embodiment and with reference to the drawings.

Figure 1:
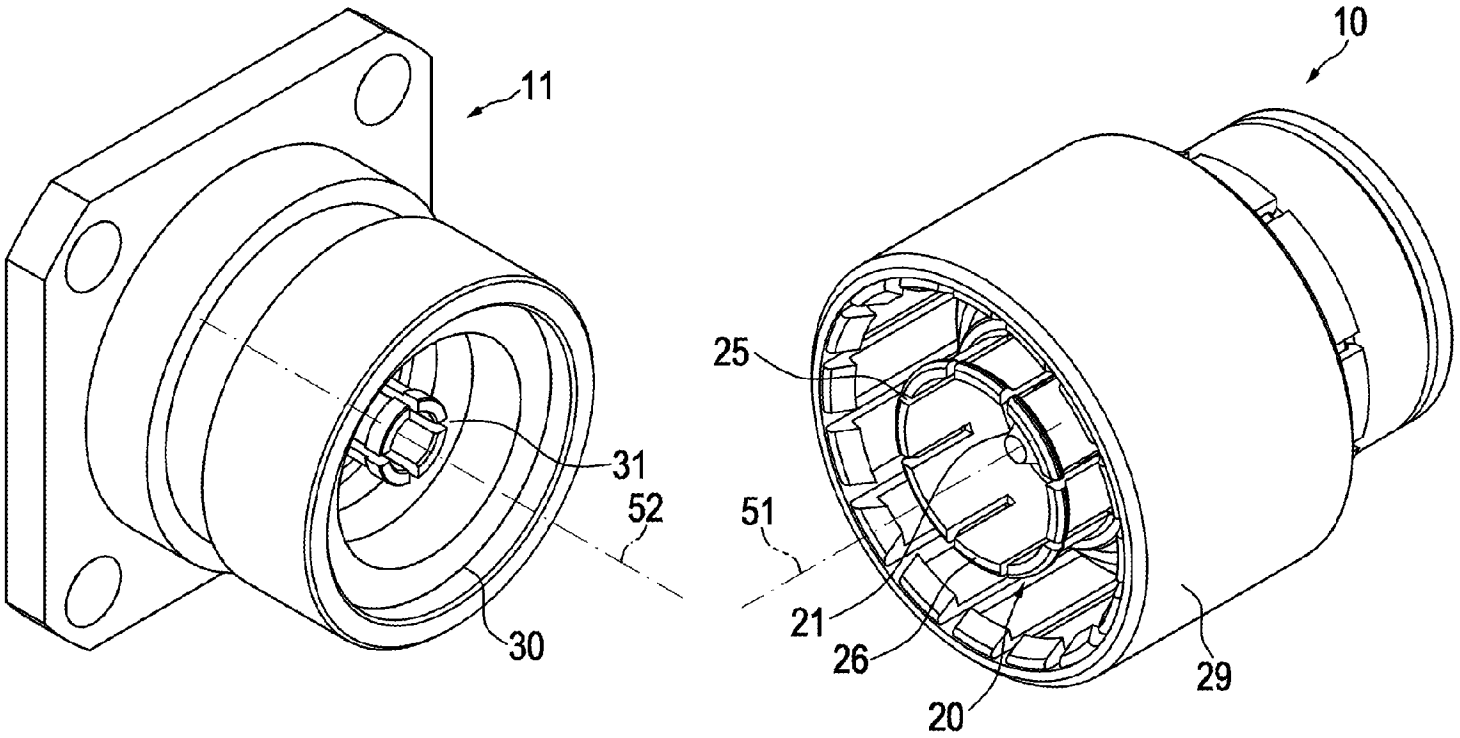
FIG. 1 shows a coaxial socket connector and a coaxial plug connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

In FIG. 1, a coaxial socket connector 11 and a coaxial plug connector 10 are shown. The coaxial socket connector 11 includes at least one center conductor 31 and one outer conductor 30. A center axis 52 of the socket connector is defined by the center of center conductor 31.

The complementary coaxial plug connector 10 includes at least one center conductor 21 and one outer conductor 20. A center axis 51 of the plug connector is defined by the center of center conductor 21. When mated with the coaxial socket connector 11, the center axis 51, 52 coincide. The outer conductor includes a plurality of slits 25 with lands in between, forming a plurality of spring loaded contact elements 26 at its socket connector-facing end. At least one locking means 29 is provided for locking or fastening the plug connector 10 to the socket connector 11. The locking means may be of screw type or bayonet type.

Figure 2:
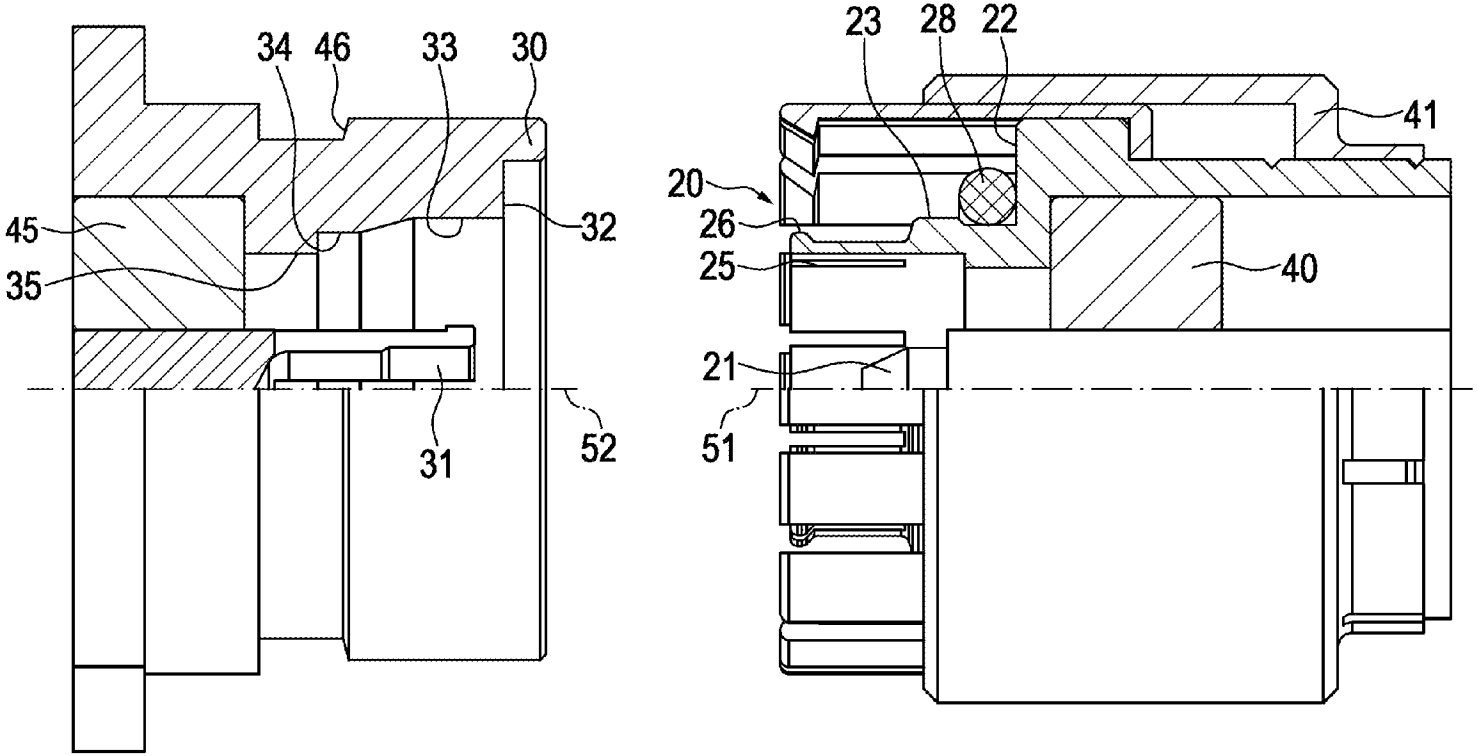
FIG. 2 shows the coaxial socket connector and the coaxial plug connector in a sectional view.

FIG. 2 shows sectional views of the socket connector 11 and the plug connector 10.

Figure 3:
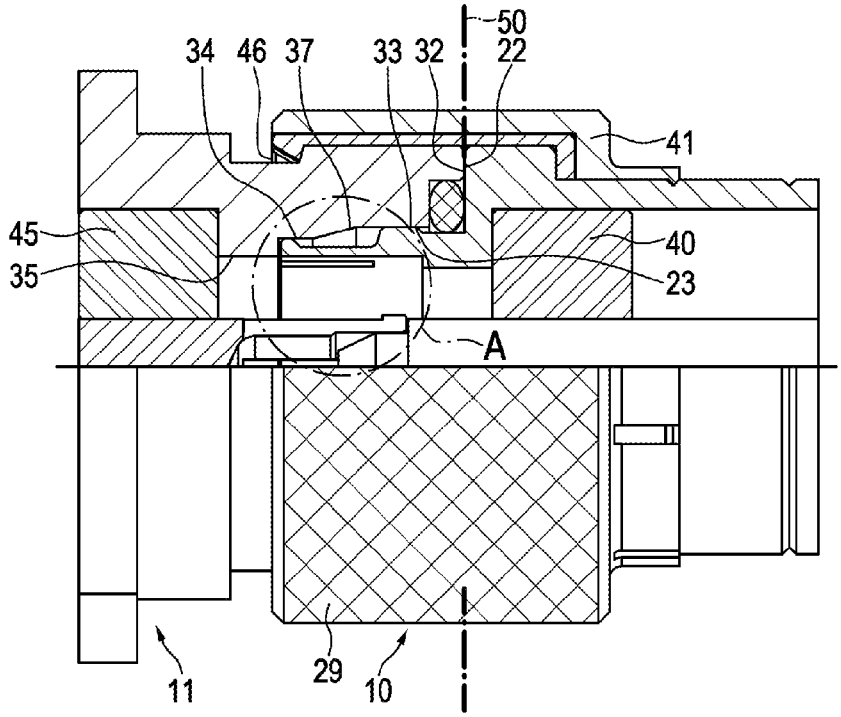
FIG. 3 shows the socket connector and the plug connector mated in a sectional view.

FIG. 3 shows both connectors 10, 11 mated together. The outer conductor 20 of plug connector 10 fits into the outer conductor 30 of socket connector 11. Furthermore, the center conductor 21 of the plug connector 10 and the center conductor 31 of the socket connector 11 are connected together. Preferably, the socket connector's 11 center conductor 31 is a female connector while the plug connector's 10 center conductor 21 is a male connector. Alternatively, the gender may be reversed. The center conductors 21, 31 are held within the outer conductors 20, 30 by means of insulators 40, 45. For locking the mated connectors, a first locking means 41 is provided at the plug connector 10, which interacts with second locking means 46 at socket connector 20.

Precision positioning of the plug connector 10 in relation to the socket connector 11 is achieved by the following means:

- The position along (in the direction of) the center axis 51 of the plug connector 10 and the center axis 52 of the socket connector 11 is defined by a mechanical contact surface 22 of the plug connector and a mechanical contact surface 32 of the socket connector, which are in close contact, when the connectors are mated. The contact plane defined by the mechanical contact surfaces is the mechanical reference plane 50 of the connector.
- Precision centering, e.g. alignment of the center axis 51 of the plug connector 10 and the center axis 52 of the socket connector 11 is done by a plug connector's precision centering means 23 which fits into a socket connector's precision centering means 33.

The plug connector's precision centering means 23 preferably has a cylindrically shaped precision-machined outer contour. The plug connector's precision centering 23 means preferably is part of the outer conductor, which allows keeping mechanical tolerances low, but it may also be separate from the outer conductor. Furthermore, the socket connector's precision centering means 33 preferably has a cylindrically shaped precision-machined inner contour, tightly fitting into the plug connector's precision centering means 23. This socket connector's precision centering 33 means may be part of the outer conductor 30, but may also be separate from the outer conductor 30. When mated, the precision centering means 23, 33 align the center axis 51 of the plug connector and the center axis 52 of the socket connector. To simplify mating of the connectors and for continuously increasing contact pressure when mating, a conical section 37 may be provided between the socket connector's precision centering means 33 and the socket connector's contact surface 34.

For achieving a good electrical contact, the plug connector's outer conductor 20 has a plurality of slits 25 extending from the socket connector-facing end of the outer conductor 20 and forming a plurality of spring loaded contact elements 26. When mated, these spring-loaded contact elements 26 electrically contact the contact area 24 with the outer conductor 30 of the socket connector at a socket connector's contact surface 34.

Figure 4:
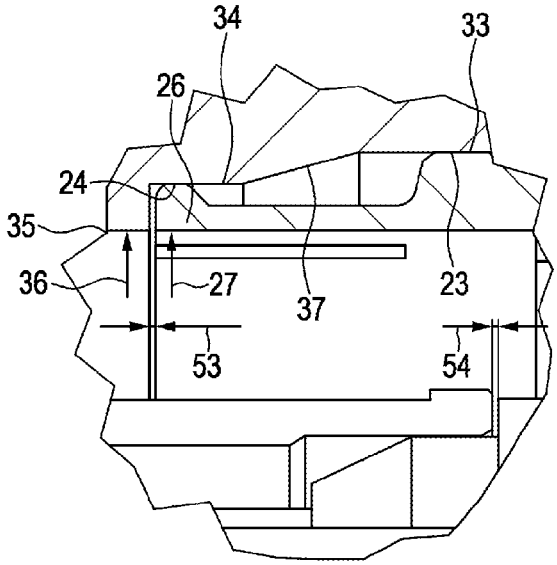
FIG. 4 shows a detail of the mated connectors.

FIG. 4 shows detail "A" of FIG. 3 in an enlarged view. To improve return loss at high frequencies, the socket connector 11 has a circular protrusion 35 at the inner side of its outer connector 30. The inner radius 36 of the protrusion preferably is the same as the inner radius 27 of the plug connector's outer conductor 20 at the socket connector-facing end, when mated. This results in an approximately constant inner radius throughout the mated connector. Furthermore, the outer connector gap 53 between the plug connector outer conductor and the inner connector gap 54 are shown. Preferably, these gaps have approximately the same very small width.

Figure 5:
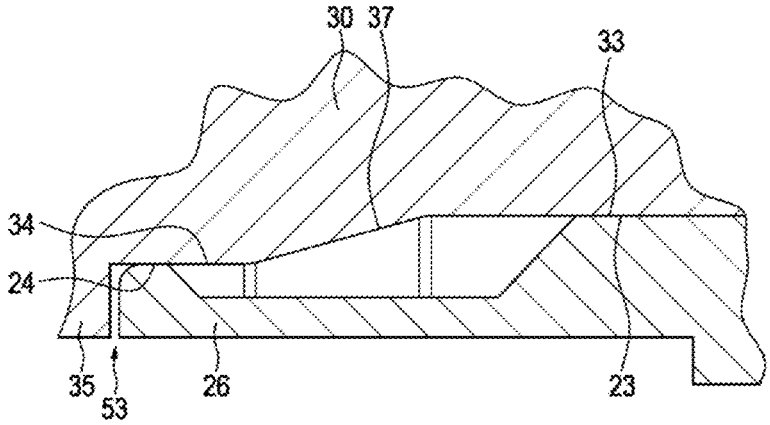
FIG. 5 shows a further detail of the connectors.
Figure 6:
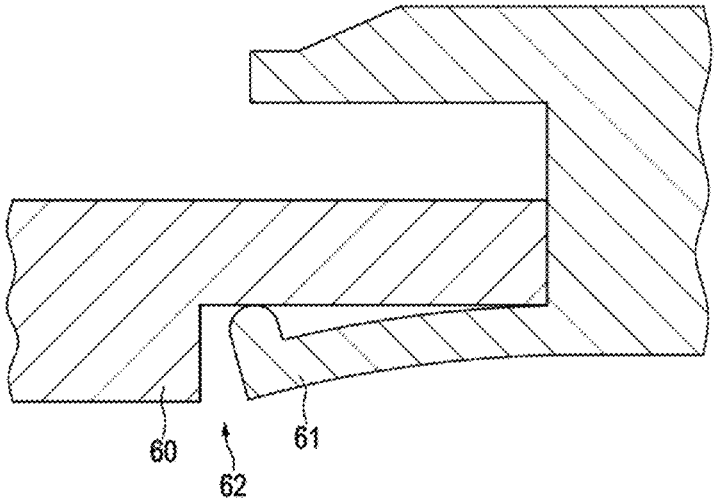
FIG. 6 (Prior Art)
FIG. 6 shows a detail of prior art.
Figure 8:
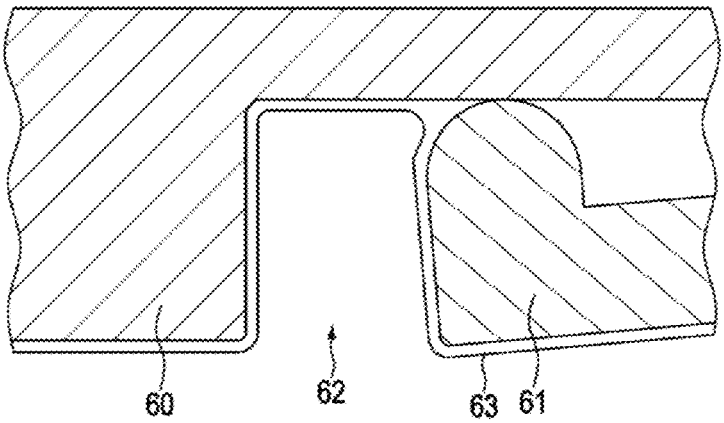
FIG. 8 (Prior Art)
FIG. 8 shows the current path between the outer conductors of prior art.

FIG. 5 shows the improvement of the embodiments over the prior art design of FIG. 6. Due to the precision alignment, specifically by axial alignment and precision centering, a narrow gap 53 with a well-defined distance can be obtained between the spring-loaded contact elements 26 and the circular protrusion 35. This results in a well-defined and short current path and efficient capacitive coupling between the spring-loaded contact elements 26 and the circular protrusion 35. Furthermore, all spring loaded contact elements 26 have the same bending and therefore the same contact pressure, resulting in a lower passive intermodulation. From prior art as shown in FIG. 8, an axial mechanical stop is known. Precision centering means are not provided and therefore radial shift between the plug connector outer conductor 61 and the socket connector outer conductor 60 is possible. This may lead to a deformation of outer conductor contact elements therefore opening the outer connector gap, which results in a lower return loss at higher frequencies. Furthermore, the deformation leads to different contact pressures of the individual contact elements thus increasing passive intermodulation. When the connector is moved or a mechanical load to the connector changes, e.g. when the cable attached to the connector is moved, or under thermal expansion of the connector, the bending of the individual contact elements is varied. This may result in a change of contact points between the individual contact elements and the socket connector outer conductor as well as the contact force. Accordingly, the passive intermodulation may increase.

Figure 7:
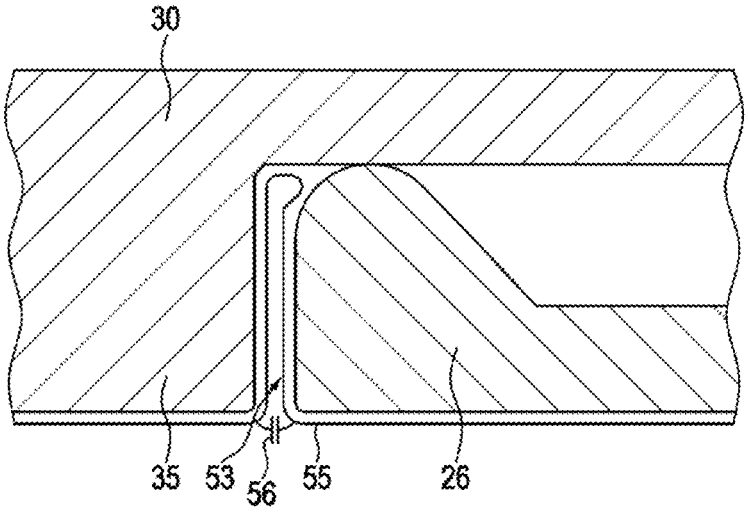
FIG. 7 shows the current path between the outer conductors.

In FIG. 7, a further detail of the contact area between the plug connector outer conductor and the socket connector outer conductor is shown in detail. The current path 55 of the radio frequency current follows the inner contour of the spring-loaded contact elements 26 and the circular protrusion 35 of the socket connector's outer conductor 30. Due to the small outer conductor gap 53 between the spring-loaded contact elements 26 and the circular protrusion 35 there is a comparatively high coupling capacitance 56 which shortcuts the gap for higher frequencies. This coupling capacitance increases return loss and further decreases passive intermodulation of the connector.

In FIG. 8, a further detail of the contact area between the plug connector outer conductor and the socket connector outer conductor of prior art is shown in detail. Again, the radio frequency current 63 follows the inner contour of the prior art plug connector's outer conductor 61 and the prior art socket connector's outer conductor 60. As the mechanical tolerances must be larger compared to the embodiments, there is a larger distance between prior art plug connector's outer conductor 61 and the prior art socket connector's outer conductor 60. Therefore the prior art outer connector's gap 62 is larger. The current path forms a comparatively large loop around the gap 62 resulting in an impedance mismatch and reduced return loss.

It will be appreciated to those skilled in the art having the benefit of this disclosure that this invention is believed to radio frequency connectors. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 coaxial plug connector
11 coaxial socket connector
20 plug connector outer conductor
21 plug connector center conductor
22 plug connector mechanical contact surface
23 plug connector precision centering means
24 plug connector outer conductor contact area
25 slits
26 spring loaded contact elements
27 inner radius at first end of plug connector outer conductor
28 O-ring
29 locking means
30 socket connector outer conductor
31 socket connector center conductor
32 socket connector mechanical contact surface
33 socket connector precision centering means
34 socket connector contact surface
35 circular protrusion
36 inner radius of protrusion
37 conical section
40 insulator
41 locking means
45 insulator
46 locking means
50 mechanical reference plane
51 center axis of the plug connector
52 center axis of the socket connector
53 outer connector gap
54 inner connector gap
55 current path
60 prior art socket connector outer conductor
61 prior art plug connector outer conductor
62 prior art outer connector gap
63 current path

The invention claimed is:

1. Coaxial plug connector comprising a center conductor defining a center axis of the connector, an outer conductor coaxial to the center conductor, the outer conductor having a substantially cylindrical shape and slits defining a plurality of spring loaded contact elements, a mechanical contact surface disposed at a right angle to the center axis and spaced from the spring loaded contact elements, the mechanical contact surface configured to limit a distance by which the plug connector can be inserted into a mating socket connector in the direction of the center axis when the plug and socket connectors are mated, and at least one precision centering means configured to align the center axis of the connector to a center axis of a mating socket connector, the at least one precision centering means having an outer transverse dimension that is larger than a maximum outer transverse dimension of the plurality of spring loaded contact elements of the outer conductor.

2. Coaxial plug connector according to claim 1, wherein the at least one precision centering means has a cylindrical outer contour which is precision machined to correspond to at least one precision centering means of a mating coaxial socket connector.

3. Coaxial plug connector according to claim 1, further comprising:

an O-ring configured to seal a gap between the outer conductor of the plug connector and an outer conductor of a mating socket connector when the plug and socket connectors are mated.

4. Coaxial connector system comprising:

a coaxial plug connector according to claim 1, and a coaxial socket connector comprising:

a center conductor defining a center axis of the connector, an outer conductor coaxial to the center conductor, the outer conductor having a substantially cylindrical shape and a conductor contact surface, a mechanical contact surface disposed at a right angle to the center axis and spaced from the conductor contact surface, the mechanical contact surface configured to limit a distance by which a plug connector can be inserted into the socket connector in the direction of the center axis when the socket and plug connectors are mated, and at least one precision centering means configured to align the center axis of the connector to a center axis of a mating plug connector.

5. Coaxial socket connector comprising:

a center conductor defining a center axis of the connector, an outer conductor coaxial to the center conductor, the outer conductor having a substantially cylindrical shape and a conductor contact surface, a mechanical contact surface disposed at a right angle to the center axis and spaced from the conductor contact surface, the mechanical contact surface configured to limit a distance by which an outer conductor of a mating plug connector can be inserted into the socket connector in the direction of the center axis when the socket and plug connectors are mated, and at least one precision centering means configured to align the center axis of the connector to a center axis of a mating plug connector, the at least one precision centering means defining an inner transverse dimension that is larger than an inner transverse dimension defined by the conductor contact surface of the outer conductor.

6. Coaxial socket connector according to claim 5, wherein the at least one precision centering means has a cylindrical inner contour which is precision machined and corresponds to at least one precision centering means of a mating coaxial plug connector.

7. Coaxial socket connector according to claim 5, wherein a circular protrusion is disposed proximal to the conductor contact surface, the circular protrusion having an inner diameter that is smaller than an inner diameter of the conductor contact surface.

8. Coaxial socket connector according to claim 7, wherein the inner diameter of the circular protrusion is the same as an inner diameter of spring loaded contact elements of a mating coaxial plug connector.

9. Coaxial socket connector according to claim 5, further comprising:

an O-ring configured to seal a gap between the outer conductor of the plug connector and an outer conductor of a mating socket connector when the socket and plug connectors are mated.

10. Coaxial connector system comprising:

a coaxial plug connector comprising:

a center conductor defining a center axis of the connector, an outer conductor coaxial to the center conductor, the outer conductor having a substantially cylindrical shape and slits defining a plurality of spring loaded contact elements, a mechanical contact surface disposed at a right angle to the center axis and spaced from the spring loaded contact elements, the mechanical contact surface configured to limit a distance by which the plug connector can be inserted into a mating socket connector in the direction of the center axis when the plug and socket connectors are mated, and at least one precision centering means configured to align the center axis of the connector to a center axis of a mating socket connector; and a coaxial socket connector according to claim 5.

* * * * *